US005884459A

United States Patent [19]

Biddlecome

[11] Patent Number: 5,884,459

[45] Date of Patent: Mar. 23, 1999

[54] ADJUSTABLE SADDLE

[76] Inventor: Ray C. Biddlecome, 4488 Sallows Road, Kelowna, Canada, V1W4C2

[21] Appl. No.: 888,942

[22] Filed: Jul. 7, 1997

Related U.S. Application Data

[60] Provisional application No. 60/021,339 Jul. 8, 1996.

[51] Int. Cl.[6] ..... B68C 1/02

[52] U.S. Cl. ..... 54/44.1

[58] Field of Search ..... 54/40.1, 44.1, 54/44.3, 44.7

[56] References Cited

U.S. PATENT DOCUMENTS

| | | | |
|---|---|---|---|
| 1,213,329 | 1/1917 | Beal | 54/44.1 |
| 1,321,398 | 11/1919 | Sievert | 54/44.3 |
| 2,353,622 | 7/1944 | Boyle | 54/44.1 |
| 3,641,739 | 2/1972 | Stubben . | |
| 4,277,933 | 7/1981 | Verdier . | |
| 4,745,734 | 5/1988 | Brown . | |
| 4,996,827 | 3/1991 | Pellew . | |
| 5,274,986 | 1/1994 | Gonzales | 54/44.4 |
| 5,343,674 | 9/1994 | Brown | 54/44.1 |
| 5,383,328 | 1/1995 | Brown | 54/44.3 |
| 5,435,116 | 7/1995 | Brown | 54/44.5 |

*Primary Examiner*—Robert P. Swiatek
*Attorney, Agent, or Firm*—Anthony C. Edwards

[57] ABSTRACT

A saddle has a saddle tree, a laterally aligned, generally arcuate, downwardly concave spanning brace mounted to, and beneath, the saddle tree, a seat member rigidly mountable to the spanning brace and extending rearwardly of the spanning brace to a cantle, the cantle extending laterally and generally parallel to the spanning brace, the spanning brace and the cantle extending laterally between, and pivotally mounted to, opposed facing mirror image longitudinally extending first and second elongate bearing members, the spanning brace and the cantle pivotally mounted to the elongate bearing members of releasably securable pivotable hinges.

11 Claims, 10 Drawing Sheets

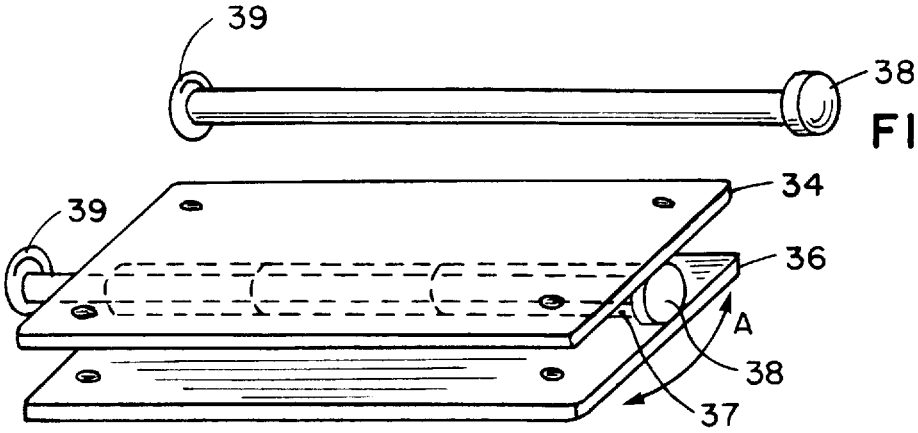
FIG. 5a
FIG. 5
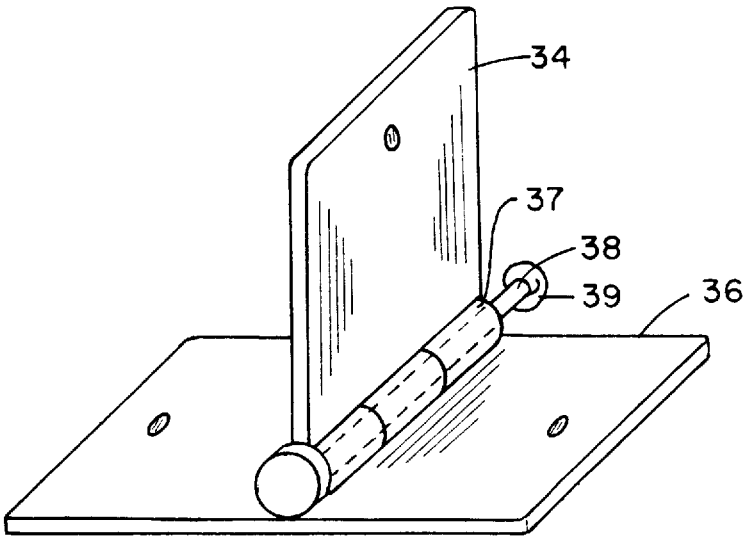
FIG. 6

ADJUSTABLE SADDLE

CROSS REFERENCE TO RELATED APPLICATION

This application claims priority from U.S. Provisional Patent Application No. 60/021,339 filed Jul. 8, 1996 titled Adjustable Saddle.

FIELD OF THE INVENTION

This invention relates to the field of saddles for horses and in particular saddles which may be adjusted to improve the fit of the saddle onto the horse.

BACKGROUND OF THE INVENTION

From the first domestication of the horse in the evolution from draft animal to the thoroughbred riding horses of today, there have been in the past continuing advances in an attempt to make both the horse and its rider more comfortable. Early cloth saddles have progressed to the now more conventional rigid saddles. However, in the construction of even the earliest saddles there was apparently an awareness that the rider preferably not contact the backbone of the horse. Thus evolved varying means of suspending the rider above the backbone of the horse.

Because of the varying sizes and shapes of horses, emphasis has been placed on designing a saddle that will comfortably fit the varying shapes and sizes of many horses without either causing abrasive wear on the horse or elaborate adjustment of the saddle. It is well known that horses have greatly varying shapes so that one saddle which comfortably fits one particular horse, may not be comfortably placed onto and ridden on another horse.

Attempts have been made in the prior art to introduce into saddle design, designs which are flexible, such as those made of flexible materials, in an attempt to provide a single saddle which may comfortably fit a variety of horse shapes. For example, applicant is aware of U.S. Pat. Nos. 5,343,674 and 5,435,116 which issued to Brown on Sep. 6, 1994, and Jul. 25, 1995, respectively. Both patents disclose a flexible saddle tree having a pair of laterally spaced apart flexible synthetic elongate members (bars) connected by a spanning member and a seat element. The Brown design teaches pivotally mounting the elongate members to the seat element at forward pivot mountings and to the spanning member at rearward pivot mountings. The elongate members are members variably flexible by means of an elongate waisted shape, and by means of forwardly extending fingers, and by various stiffening members mounted to the elongate members. The elongate members are padded on their interior surfaces so as to cover the otherwise exposed heads of the bolts which secure the elongate members onto corresponding pivot fulcrums mounted to the saddle tree. Flexing motion of the elongate members is accommodated by pivotal motion having two degrees of freedom, that is, the members are free to rock on the pivot fulcrums.

What is neither contemplated, taught, nor suggested, is an acknowledgement that a single set of bars cannot be properly employed to fit a wide variety of horse shapes and thus that it may be required to quickly and, preferably, easily interchange one set of elongate members with a differently shaped second set of elongate members. Thus, it is an object of the present invention to provide a much less complicated structure than that of Brown, where each pair of elongate members may be tailored to the shape of a particular horse, rather than attempting to provide a single saddle for all horse shapes. In the present invention, a simplified design of pivotable elongate members may be quickly and easily interchanged with elongate members having a different shape, adapted to comfortably fit the saddle onto a differently shaped horse.

SUMMARY OF THE INVENTION

The saddle of the present invention includes a saddle tree, a laterally aligned, generally arcuate, downwardly concave spanning brace mounted to, and beneath, the saddle tree, and a seat member rigidly mountable to the spanning brace and extending rearwardly of the spanning brace to a cantle. The cantle extends laterally and generally parallel to the spanning brace. The spanning brace and the cantle extend laterally between, and are pivotally mounted to, opposed facing mirror image longitudinally extending rigid first and second elongate bearing members. The spanning brace and the cantle are pivotally mounted to the elongate bearing members by means of releasably securable pivotable mounting means.

The releasably securable mounting means may include opposed upper and lower mounting plates, secured respectively to the corresponding spanning brace or cantle, and to the elongate bearing members. The mounting plates when thus secured align collars rigidly mounted to the mounting plates for releasably securable journalling of elongate pins through the collars along generally parallel and longitudinally extending, laterally spaced apart, first and second axes of rotation.

The mounting plates form opposed mirror image pairs of forward and rearward pinned hinges, wherein first and second pins lie along the first axis of rotation when releasably secured in one of the pairs of forward and rearward pinned hinges when mounted to the first elongate bearing member. Third and fourth pins lie along the second axis of rotation when releasably secured in the other of the pairs of forward and rearward pinned hinges when mounted to the second elongate bearing member. The first and second elongate members are shaped to correspond to the shape of a particular horse. The elongate bearing members are pivotable about the longitudinal axes of rotation so as to conform to the width and shape of that particular horse. The elongate bearing members may be quickly interchanged with other differently shaped elongate bearing members for improved fit of the saddle onto a second horse, for example a horse having an excessively swayed back or high wither.

Advantageously, the spanning brace is a rigid frame member, where the frame provides at its lateral ends rigid mounting means for rigid mounting of the upper mounting plates thereto. In one embodiment, the upper mounting plates extend equidistant on either side of the collars. In a second embodiment, the upper mounting plates depend radially, so as to extend in one direction, from the collars.

BRIEF DESCRIPTION OF THE DRAWINGS

FIG. 5 is, in perspective view, the pinned hinges of one embodiment.

FIG. 5*a* is, in perspective view, the pin of the pinned hinge of FIG. 5.

FIG. 6 is, in perspective view, a pinned hinge of a second embodiment.

DETAILED DESCRIPTION OF THE PREFERRED EMBODIMENT

Figure 1:
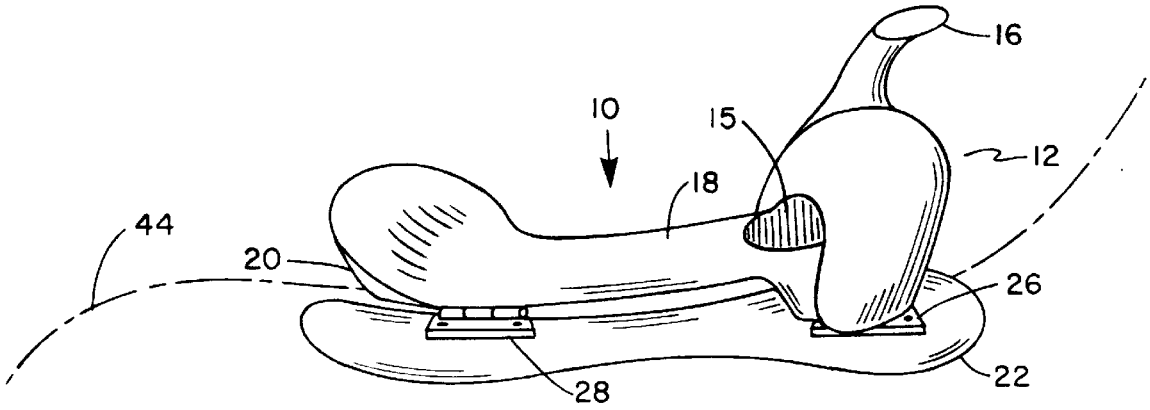
FIG. 1 is, in side elevation view, the adjustable saddle of the present invention in a western styling.
Figure 2:
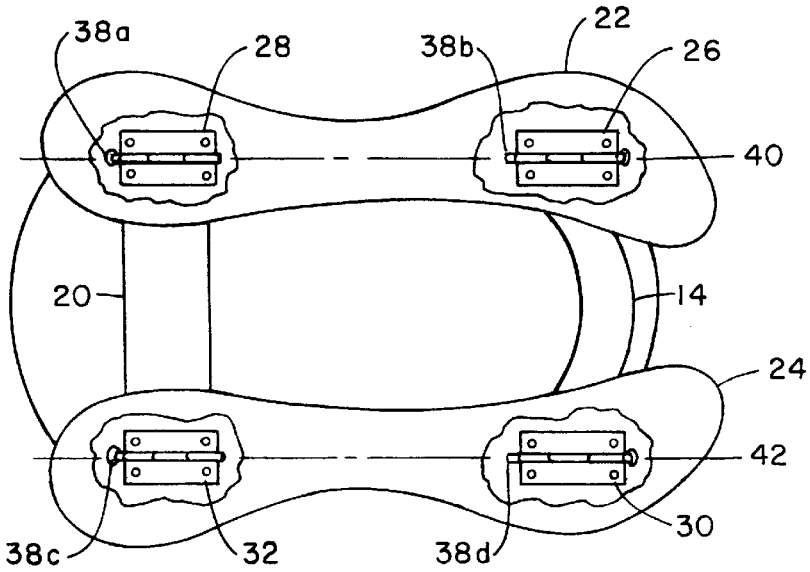
FIG. 2 is, in bottom, partial cut-away view, the adjustable saddle of FIG. 1.
Figure 3:
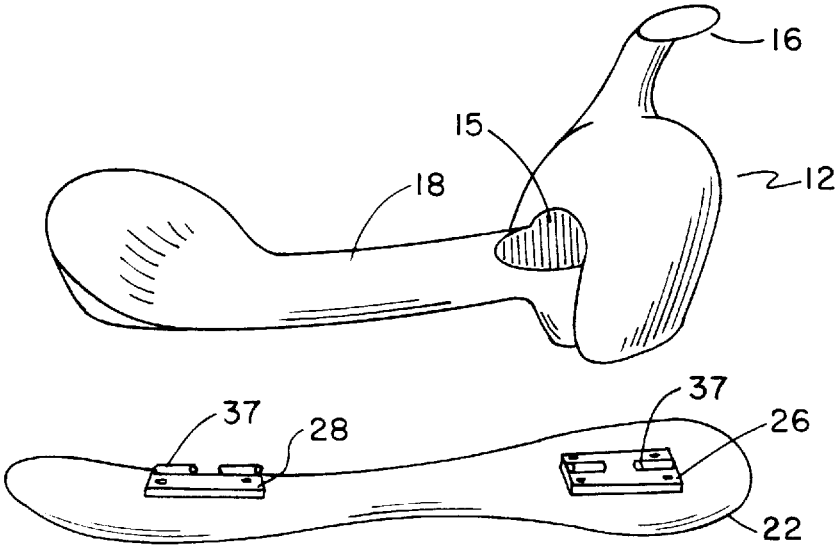
FIG. 3 is, in exploded side elevation view, the adjustable saddle of FIG. 1.
Figure 4:
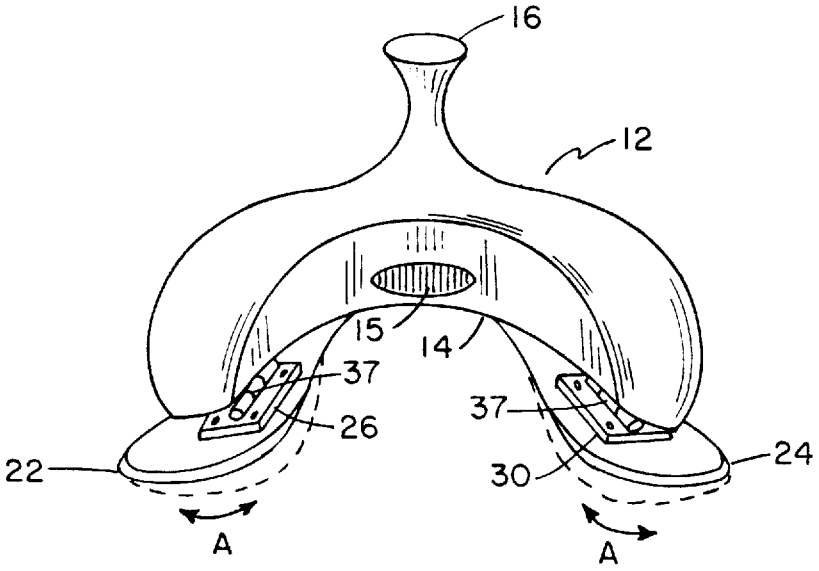
FIG. 4 is, in front elevation view, the adjustable saddle of FIG. 1.

The saddle 10 incorporating the present invention is seen in one preferred embodiment in FIGS. 1–4. A western saddle is illustrated by way of example only and is not intended to be limiting. Saddle tree 12 includes a laterally aligned, generally arcuate, downwardly concave spanning brace 14 having aperture 15. Horn 16 is rigidly mounted thereto and extends upwardly therefrom. Saddle tree 12, including spanning brace 14 and horn 16, and seat member 18 may be made of fibreglass and covered with leather. Seat member 18 is rigidly mounted to the spanning brace 14 and extends rearwardly of the spanning brace to a cantle 20. The cantle 20 extends laterally and generally parallel to the spanning brace 14. Spanning brace 14 and cantle 20 extend laterally between, and are pivotally mounted to, opposed facing mirror image longitudinally extending first and second elongate bearing members, such as bars or paddles, 22 and 24 respectively.

Spanning brace 14 and cantle 20 are pivotally mounted to elongate bearing members 22 and 24 by means of releasably securable pivotable mounting means such as corresponding forward and rearward opposed pairs of pinned hinges 26, 28, 30 and 32. Each of pinned hinges 26, 28, 30 and 32 has upper and lower mounting plates 34 and 36 respectively, as seen by way of example in FIG. 5. Mounting plates 34 and 36 are secured, respectively, to their corresponding spanning brace 14 or cantle 20, and corresponding elongate bearing members 22 or 24.

Mounting plates 34 and 36 when thus secured align collars 37 rigidly mounted to the mounting plates for releasably securable journalling of elongate pins 38, better seen by way of example in FIG. 5*a*, therethrough along generally parallel and longitudinally extending, laterally spaced apart, first and second axes of rotation 40 and 42. In particular, first and second pins 38*a* and 38*b* lie along first axis of rotation 40 when releasably secured in forward and rearward pinned hinges 26 and 28 mounted to first elongate bearing member 22. Third and fourth pins 38*c* and 38*d* lie along second axis of rotation 42 when releasably secured in forward and rearward pinned hinges 30 and 32 mounted to second elongate bearing member 24. Pins 38 may be secured in collars 37 by split rings 39, or like releasable pin securing means known in the art.

By means of pinned hinges 26,28,30 and 32 so aligned, elongate bearing members 22 and 24 are pivotable in direction A about longitudinal axes of rotation 40 and 42 so as to conform the orientation of the bearing members to the width of a horse 44 and so that the bearing members may be quickly interchanged with other differently shaped bearing members for improved fitment of saddle 10 onto a particular horse 44, for example a horse having an excessively swayed back or high wither.

Figure 11:
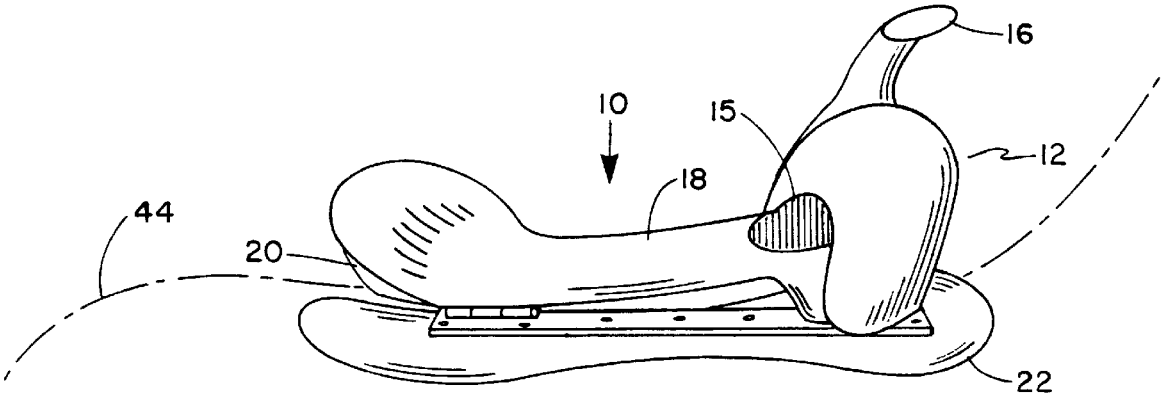
FIG. 11 is, in side elevation view, an alternative embodiment of the adjustable saddle of the present invention.
Figure 12:
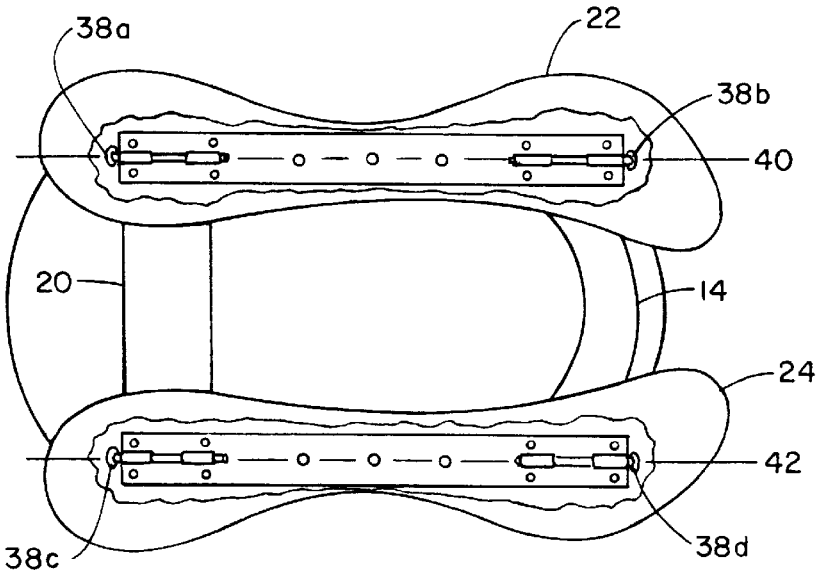
FIG. 12 is, in bottom, partial cut-away view, the adjustable saddle of FIG. 11.
Figure 13:
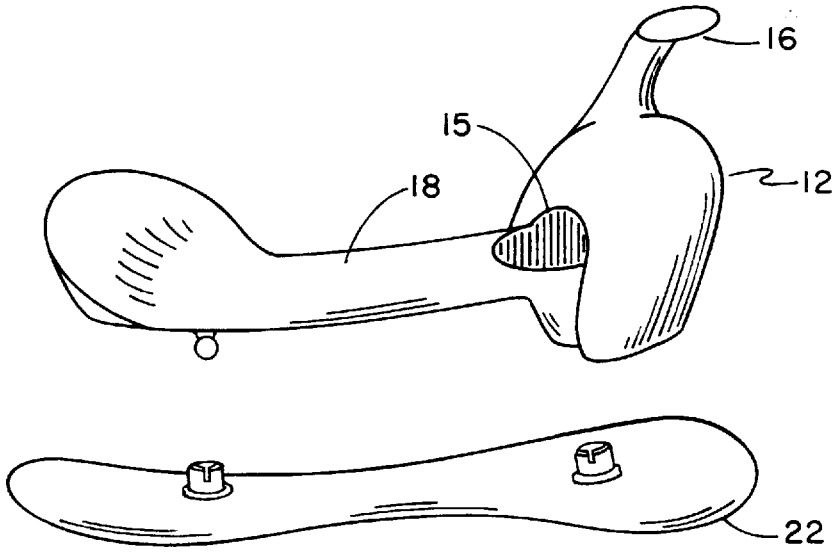
FIG. 13 is, in exploded side elevation view, an alternative embodiment of the adjustable saddle of the present invention.
Figure 14:
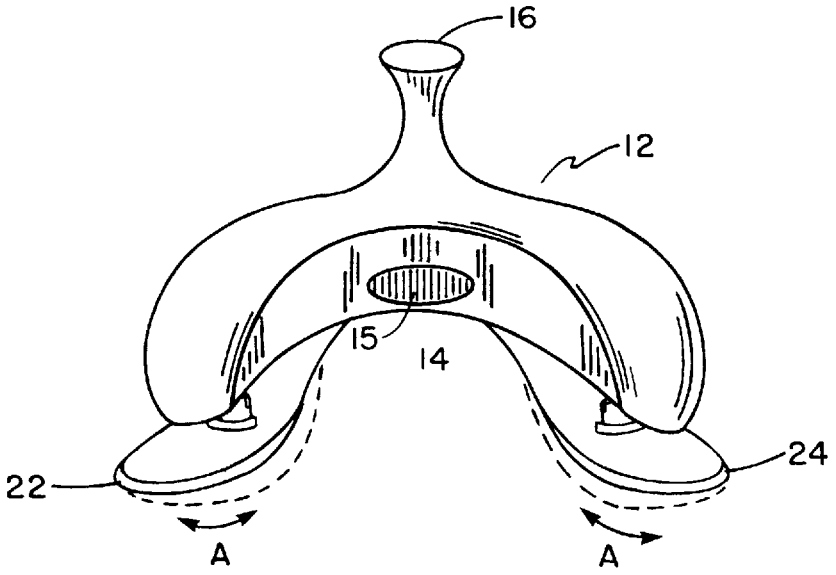
FIG. 14 is, in front elevation view, the adjustable saddle of FIG. 13.
Figure 15:
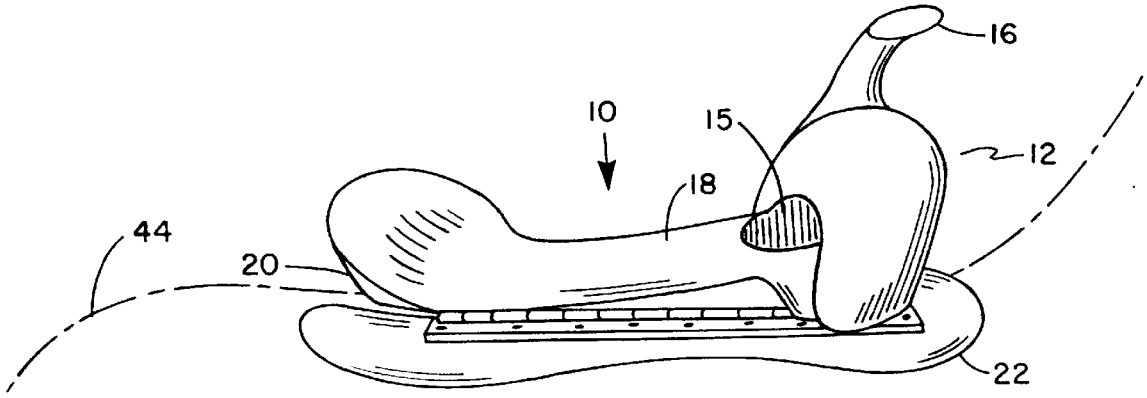
FIG. 15 is, in side elevation view, an alternative embodiment of the adjustable saddle of the present invention.
Figure 16:
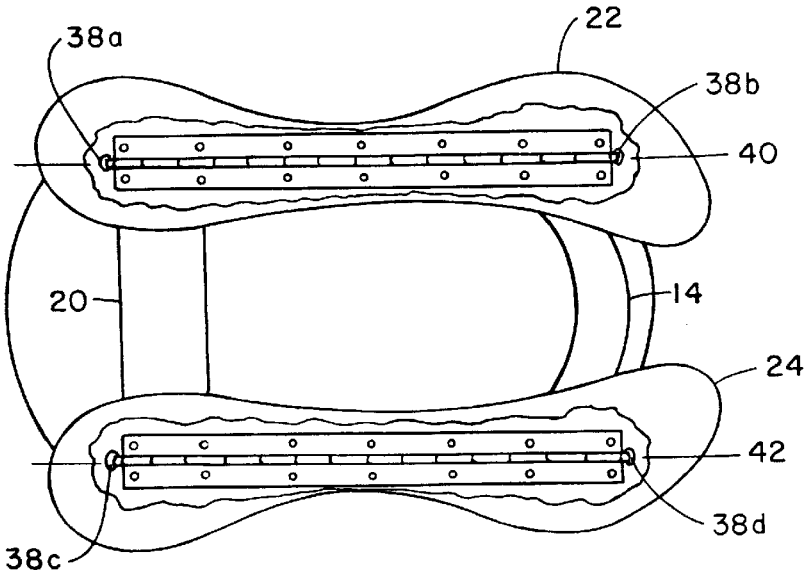
FIG. 16 is, in side elevation view, an alternative embodiment of the adjustable saddle of the present invention.

It is within the scope of this invention to incorporate other forms of hinges, so long as the paddles may pivot in direction A. For example, but not intended to be limiting, the hinges may be mounted by way of common elongate hinge plates such as seen in FIGS. 11 and 12. The hinges may also be ball and socket hinges such as depicted by way of example in FIGS. 13 and 14, or may be flexible piano hinges such as depicted by way of example in FIGS. 15 and 16. Other forms of hinges may include strap hinges, clam-shell hinges or other forms of pin-less hinges.

The spanning brace 14 may be a rigid metal frame member encased in Rawlide (TM) plastic, or other materials known in the art, shaped to provide the shape of a conventional saddle. The metal frame thus provides at its lateral ends rigid mounting points for rigid mounting of the upper mounting plates 34 thereto. Mounting plates 34 and 36 may also be moulded into the Rawlide (TM) plastic. The upper mounting plates 34 in the first preferred embodiment extend equidistant on either side of collars 37 and pin 38. The upper mounting plates 34 in a second preferred embodiment seen in FIG. 6 extend radially in one direction from collars 37 and pin 38.

Figure 7:
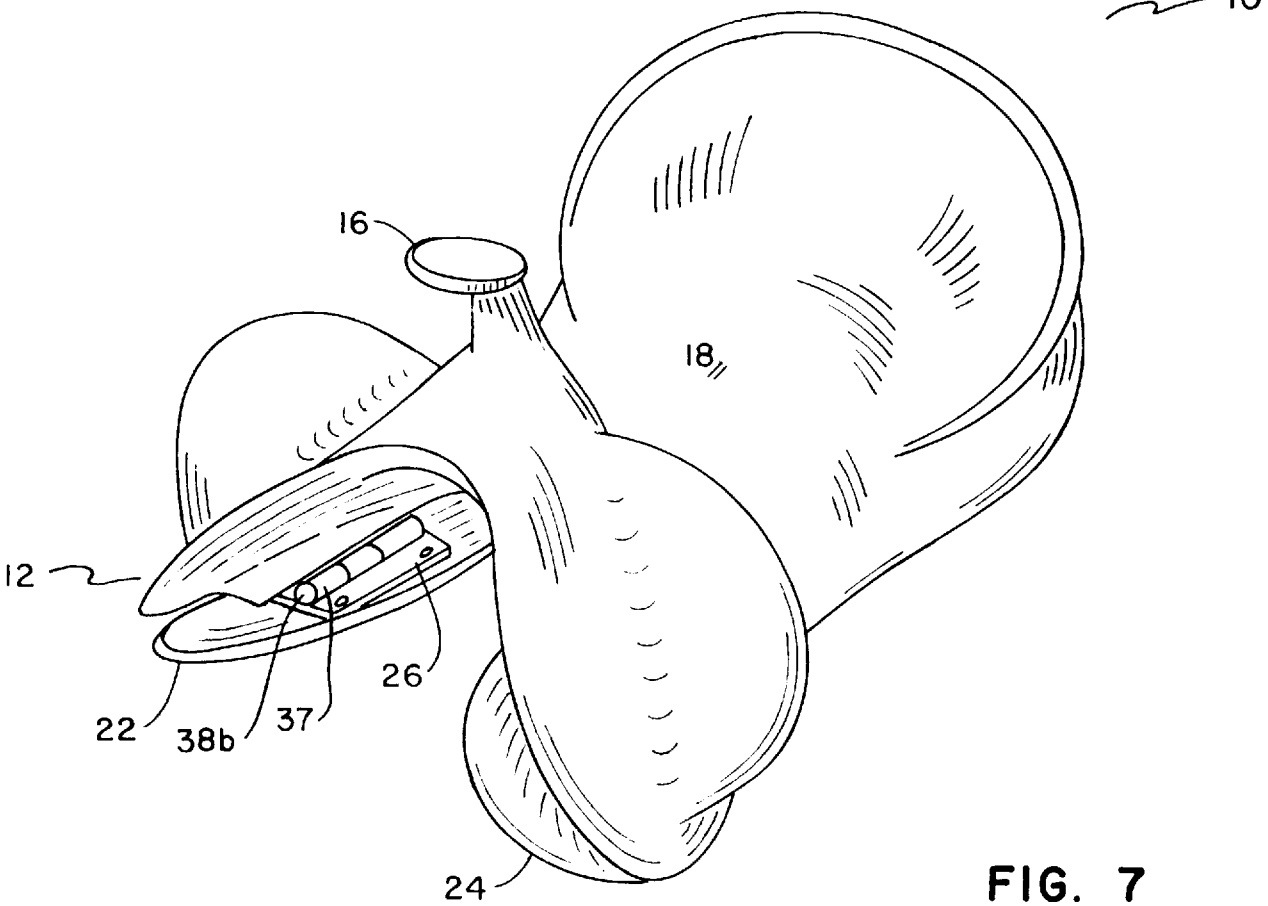
FIG. 7 is, in perspective view, the adjustable saddle of the present invention in an Australian styling.
Figure 8:
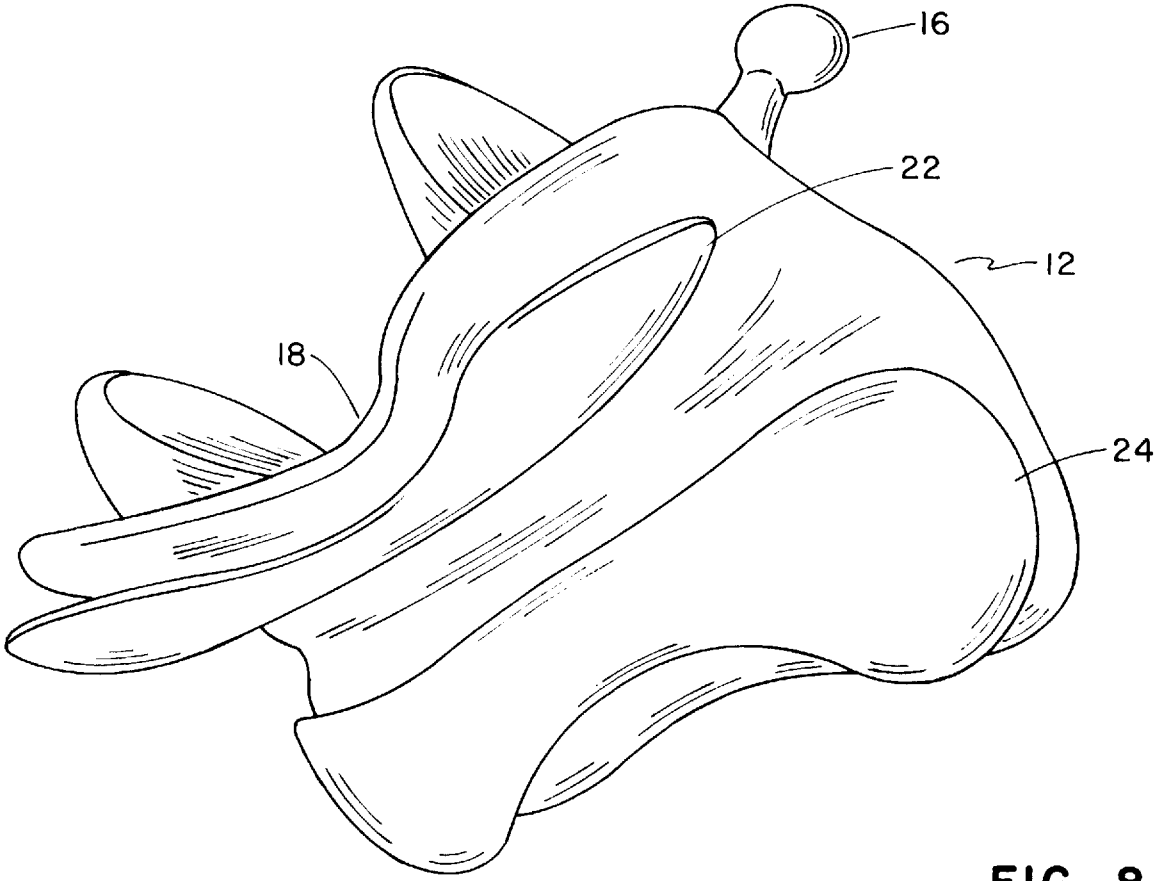
FIG. 8 is, in bottom perspective view, the adjustable saddle of FIG. 7.
Figure 9:
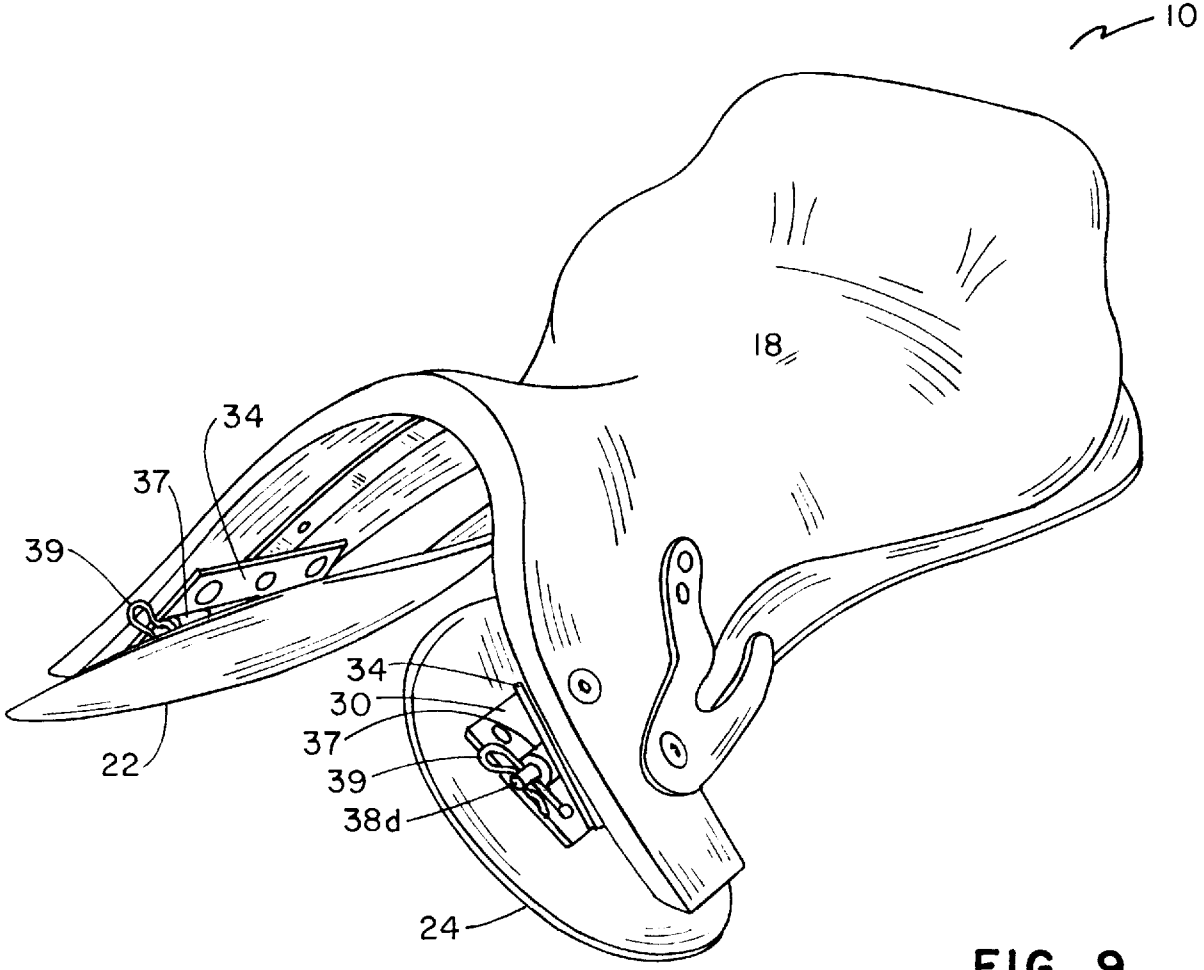
FIG. 9 is, in perspective view, the adjustable saddle of the present invention in an English styling.
Figure 10:
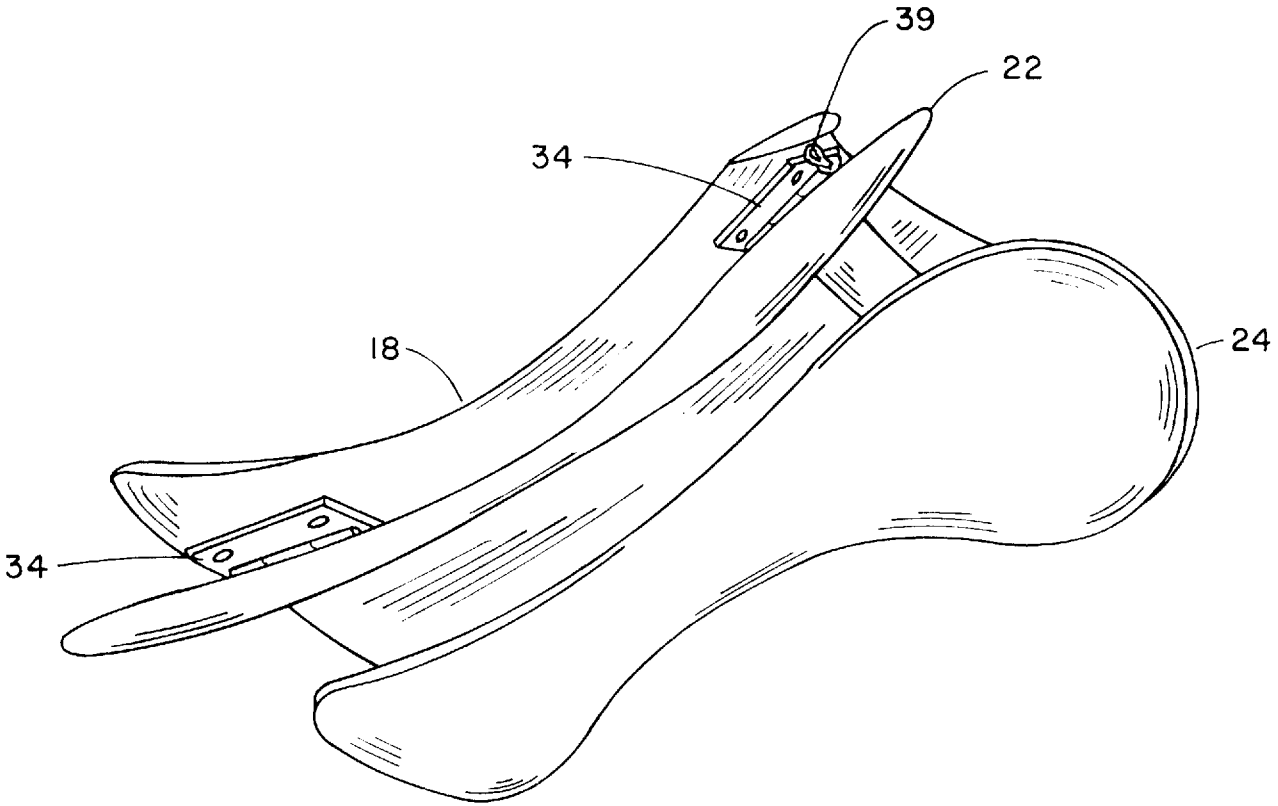
FIG. 10 is, in bottom perspective view, the adjustable saddle of FIG. 9.

FIGS. 7 and 8 illustrate the present invention incorporated into an Australian style saddle. FIGS. 9 and 10 illustrate the present invention incorporated into an English style saddle. FIGS. 7–10 are by way of example and not intended to be limiting as to the various styles of saddle into which the present invention may be incorporated.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A saddle comprising a saddle tree, a laterally aligned, generally arcuate, downwardly concave spanning brace mounted to, and beneath, said saddle tree, a seat member rigidly mountable to said spanning brace and extending rearwardly of said spanning brace to a cantle, said cantle extending laterally and generally parallel to said spanning brace, said spanning brace and said cantle extending laterally between, and pivotally mounted to, opposed facing mirror image longitudinally extending generally rigid first and second elongate bearing members, said rigid first and second elongate bearing members extending rigidly between respective longitudinal ends of said first and second elongate bearing members, said spanning brace and said cantle pivotally mounted to said elongate bearing members, by means of releasably securable pivotable mounting means, so as to only pivot about a corresponding pair of longitudinally extending, laterally spaced apart, first and second axes of rotation.

2. The saddle of claim 1 wherein said releasably securable mounting means comprises opposed upper and lower mounting plates, secured respectively to corresponding said spanning brace or said cantle and said elongate bearing members, said mounting plates when thus secured aligning collars rigidly mounted to said mounting plates for releasably securable journalling of elongate pins through said collars along generally parallel said longitudinally extending, laterally spaced apart, first and second axes of rotation.

3. The saddle of claim 2 wherein said mounting plates form opposed mirror image pairs of forward and rearward pinned hinges, and wherein first and second pins lie along said first axis of rotation when releasably secured in one of said pairs of said forward and rearward pinned hinges when mounted to said first elongate bearing member, and wherein third and fourth pins lie along said second axis of rotation when releasably secured in the other of said pairs of said forward and rearward pinned hinges when mounted to said second elongate bearing member, and wherein said first and second elongate members are shaped to correspond to a particular shape of a first horse, whereby said elongate bearing members are pivotable about said longitudinal axes of rotation so as to conform to the width of said first horse and may be quickly interchanged with other differently shaped elongate bearing members for improved fitment of said saddle onto a second horse.

4. The saddle of claim 3 wherein said spanning brace is a rigid frame member, said frame providing at its lateral ends rigid mounting means for rigid mounting of said upper mounting plates thereto.

5. The saddle of claim 4 wherein said upper mounting plates extends equidistant on either side of said collars.

6. The saddle of claim 4 wherein said upper mounting plates depending radially, so as to extend in one direction, from said collars.

7. A saddle comprising a saddle tree, a laterally aligned, generally arcuate, downwardly concave spanning brace mounted to, and beneath, said saddle tree, a seat member rigidly mountable to said spanning brace and extending rearwardly of said spanning brace to a cantle, said cantle extending laterally and generally parallel to said spanning brace, said spanning brace and said cantle extending laterally between, and pivotally mounted to, opposed facing mirror image longitudinally extending rigid first and second elongate bearing members, said spanning brace and said cantle pivotally mounted to said elongate bearing members by means of releasably securable pivotable mounting means, wherein said releasably securable mounting means comprises opposed upper and lower mounting plates, secured respectively to corresponding said spanning brace or said cantle and said elongate bearing members, said mounting plates when thus secured aligning collars rigidly mounted to said mounting plates for releasably securable journalling of elongate pins through said collars along generally parallel and longitudinally extending, laterally spaced apart, first and second axes of rotation.

8. The saddle of claim 7 wherein said mounting plates form opposed mirror image pairs of forward and rearward pinned hinges, and wherein first and second pins lie along said first axis of rotation when releasably secured in one of said pairs of said forward and rearward pinned binges when mounted to said first elongate bearing member, and wherein third and fourth pins lie along said second axis of rotation when releasably secured in the other of said pairs of said forward and rearward pinned hinges when mounted to said second elongate bearing member, and wherein said first and second elongate members are shaped to correspond to a particular shape of a first horse, whereby said elongate bearing members are pivotable about said longitudinal axes of rotation so as to conform to the width of said first horse and may be quickly interchanged with other differently shaped elongate bearing members for improved fitment of said saddle onto a second horse.

9. The saddle of claim 8 wherein said spanning brace is a rigid frame member, said frame providing at its lateral ends rigid mounting means for rigid mounting of said upper mounting plates thereto.

10. The saddle of claim 9 wherein said upper mounting plates extend equidistant on either side of said collars.

11. The saddle of claim 9 wherein said upper mounting plates depending radially, so as to extend in one direction, from said collars.

* * * * *